US006152386A

United States Patent [19]

Bullock et al.

[11] Patent Number: 6,152,386

[45] Date of Patent: Nov. 28, 2000

[54] HANDGUN AND HOSE ASSEMBLY FOR DISPENSING LIQUIDS

[75] Inventors: David F. Bullock, Pacific Grove; Patrick C. Pagnella, Monterey, both of Calif.

[73] Assignee: Nordson Corporation, Westlake, Ohio

[21] Appl. No.: 09/301,789

[22] Filed: Apr. 29, 1999

Related U.S. Application Data

[60] Provisional application No. 60/107,315, Nov. 6, 1998.

[51] Int. Cl.[7] ..... B05B 7/02; B05B 1/24

[52] U.S. Cl. ..... 239/525; 239/135; 239/397.5

[58] Field of Search ..... 239/135, 139, 239/128, 104, 106, 119, 397.5, 537, 541, 525, 530, 588, 589; 222/146.1, 146.2, 146.5

[56] References Cited

U.S. PATENT DOCUMENTS

| | | | |
|---|---|---|---|
| 2,469,642 | 5/1949 | Grewe | 239/541 |
| 2,670,241 | 2/1954 | Pyles | 299/150 |
| 3,827,604 | 8/1974 | Hamilton et al. | 222/146 |
| 4,260,130 | 4/1981 | Brehm | 239/541 X |
| 4,667,084 | 5/1987 | Regge | 239/135 X |
| 4,932,592 | 6/1990 | Abbott et al. | 239/588 X |
| 5,074,443 | 12/1991 | Fujii et al. | 222/639 |
| 5,375,738 | 12/1994 | Walsh et al. | 222/1 |
| 5,383,605 | 1/1995 | Teague | 239/525 X |
| 5,535,919 | 7/1996 | Ganzer et al. | 222/1 |

OTHER PUBLICATIONS

Adhesive Technologies, Inc., *The Ad–Tech™ MBS Hot Melt Mini–Bulk System*, Brochure, Oct. 1998.

Nordson Corporation, *Drawing of Model 656501, Hand Gun Assembly*, Undated.

*Primary Examiner*—Andres Kashnikow
*Assistant Examiner*—Davis Hwu
*Attorney, Agent, or Firm*—Wood, Herron & Evans, L.L.P.

[57] ABSTRACT

A heated handgun and hose assembly adapted to dispense heated liquids, such as hot melt adhesives, coatings, sealants, caulks and various other materials. The handgun and hose assembly includes a gripping portion and an actuating lever extending generally in line with the hose. The actuating lever operates a valve integrated with the nozzle to selectively allow or prevent the flow of liquid through the nozzle. A connection between the actuating lever and the nozzle limits the stroke of the valve and the travel of the actuating lever. A hose heater and multi-layer insulating materials wrap around the body of the valve as well as along the entire length of the hose. A membrane switch is incorporated into the actuating lever for applications utilizing an electrically-operated pump. The valve includes a suck-back feature to improve liquid cut-off and to prevent drooling of liquid from the nozzle outlet.

16 Claims, 3 Drawing Sheets

HANDGUN AND HOSE ASSEMBLY FOR DISPENSING LIQUIDS

This application is based on and claims the priority of Provisional Application Ser. No. 60/107,315, filed Nov. 6, 1998, which is hereby fully incorporated by reference herein.

FIELD OF THE INVENTION

The present invention generally relates to liquid dispensing devices and, more particularly, to a heated hose and handgun assembly for dispensing liquids, such as hot melt adhesives, coatings, sealants and caulks.

BACKGROUND OF THE INVENTION

Various types of dispensers are used in many industries for accurately placing liquids, such as hot melt adhesives, coatings, sealants and caulks, on substrates. These include both automatic and manual dispensing systems. Manual dispensing systems typically utilize a handgun attached to a hose allowing the operator to direct a bead of hot melt adhesive, for example, onto one or more substrates during an assembly process. Often, the handgun and attached hose must be manipulated through these various patterns for extended periods during each day. Generally, these units should be easy for an operator to handle for extended periods of time. Unfortunately, many dispensers of this type are relatively heavy, pistol grip handguns. In addition to the weight, pistol grip dispensers cannot be easily manipulated through some patterns and are designed to be gripped by the operator in only one hand orientation. Thus, while the pistol grip can be advantageous for some applications, it can lead to operator fatigue and other difficulties in other applications.

Another problem often associated with hand-operated or manual dispensers relates to difficulties in maintenance and repair. These dispensers usually have internal valve mechanisms for on/off control of the liquid discharge. Such valve mechanisms need regular maintenance and repair and, in many dispensers, access to these valve mechanisms often proves to be quite time consuming due to the required disassembly of the gun.

Many hand gun dispensers also have a problem with liquid cut off. That is, immediately after the valve mechanism of the gun is closed, liquid will still drip or drool from the nozzle of the gun. This can lead to dripped, drooled or stringing adhesive or other liquid on undesired areas of a substrate or other undesired areas around the operator.

For the reasons expressed above, as well as other reasons, it would be desirable to provide an improved hand gun and hose assembly which, for example, is less likely to cause fatigue during use and is easy to manipulate, easy to maintain and repair, and not prone to dripping or drooling upon shut-off.

SUMMARY OF THE INVENTION

The present invention provides a heated handgun and hose assembly adapted to dispense heated liquids, such as hot melt adhesives, coatings, sealants, caulks and various other materials. The handgun and heated hose assembly includes various unique features facilitating easier operation and maintenance as well as reliability and versatility.

In one aspect, the present invention provides a heated handgun and hose assembly which more efficiently and uniformly heats liquid until it is discharged from a nozzle associated with the assembly. More specifically, a hose is provided having a multi-layer construction including a hose core with a liquid flow passage and additional layers including an electric heating layer and at least one layer of thermal insulation. A tubular member including a valve is mounted within one end of the heated hose. A nozzle having an outlet is connected for thermal and fluid communication with the tubular member. An actuating member is coupled to the valve for moving the valve between open and closed positions to respectively allow and prevent liquid flow through the passage in the hose core and through the tubular member and nozzle outlet. In this aspect, since the tubular member is surrounded by the heated hose, heat is transferred directly to the liquid through the tubular member and the nozzle.

In another aspect of the invention, a handgun and hose assembly, which may or may not be heated, includes an actuating member having a manually operable actuating portion coupled to the valve member and further includes a straight, tubular gripping portion coupled in generally surrounding relation to the end portion of the hose. In this aspect of the invention, the straight, tubular gripping portion, the actuating portion, and the end portion of the hose each extend generally parallel to one another. The actuating member is preferably a lever which may be depressed toward the gripping portion to activate a valve member associated with the assembly. This assembly allows a user to grasp the unit and simultaneously actuate the lever in at least two convenient manners. For example, the gripping portion may be grasped with the index finger and thumb closest to the nozzle or with the index finger and thumb farthest from the nozzle. Due to this feature, the handgun and hose assembly may be mounted to extend downwardly toward the user, laterally toward the user, or from below the user depending on the application requirements. The assembly is less fatiguing and easier to manipulate during use due to this aspect of the invention.

The actuating lever is connected for movement with the valve and, preferably, also the nozzle. More specifically, by moving the nozzle, the valve is also operated to selectively allow or prevent the flow of liquid through the nozzle. A connection between the actuating lever and the valve and/or the nozzle advantageously limits the stroke of the valve. The valve further comprises a plunger operable with respect to a valve seat. More specifically, the nozzle may be formed in one piece with the plunger or as a separately attached piece. Separate pieces, for example, easily allow different nozzle configurations to be connected to the gun. The plunger and valve seat are easily removable from the tubular member for maintenance purposes. The tubular member, plunger, valve seat and nozzle components are formed from materials having high heat transfer properties, such as copper alloys, to ensure that the nozzle tip remains heated during operation. Conversely, metals having low heat transfer properties are used to form other components of the handgun, such as the actuating lever, to limit exposure of heated components to the user.

Additional aspects of the invention include a membrane switch which is incorporated into the actuating lever for those applications utilizing an electrically-operated pump. A layer of foam covers the gripping portion of the handgun to increase comfort and decrease fatigue on the part of the user. In applications that do not require an electric switch in the actuating lever, the lever may be converted to a swiveling lever allowing easier manipulation of the handgun by the user. After the valve shuts off the flow of liquid from the nozzle, the valve operates further to provide a suck-back effect at the nozzle to improve cut-off and prevent drooling of liquid material from the nozzle outlet.

Other advantages, objectives, and features of the invention will become more readily apparent to those of ordinary skill in the art upon review of the following detailed description taken in conjunction with the accompanying drawings.

DETAILED DESCRIPTION OF THE PREFERRED EMBODIMENT

Figure 1:
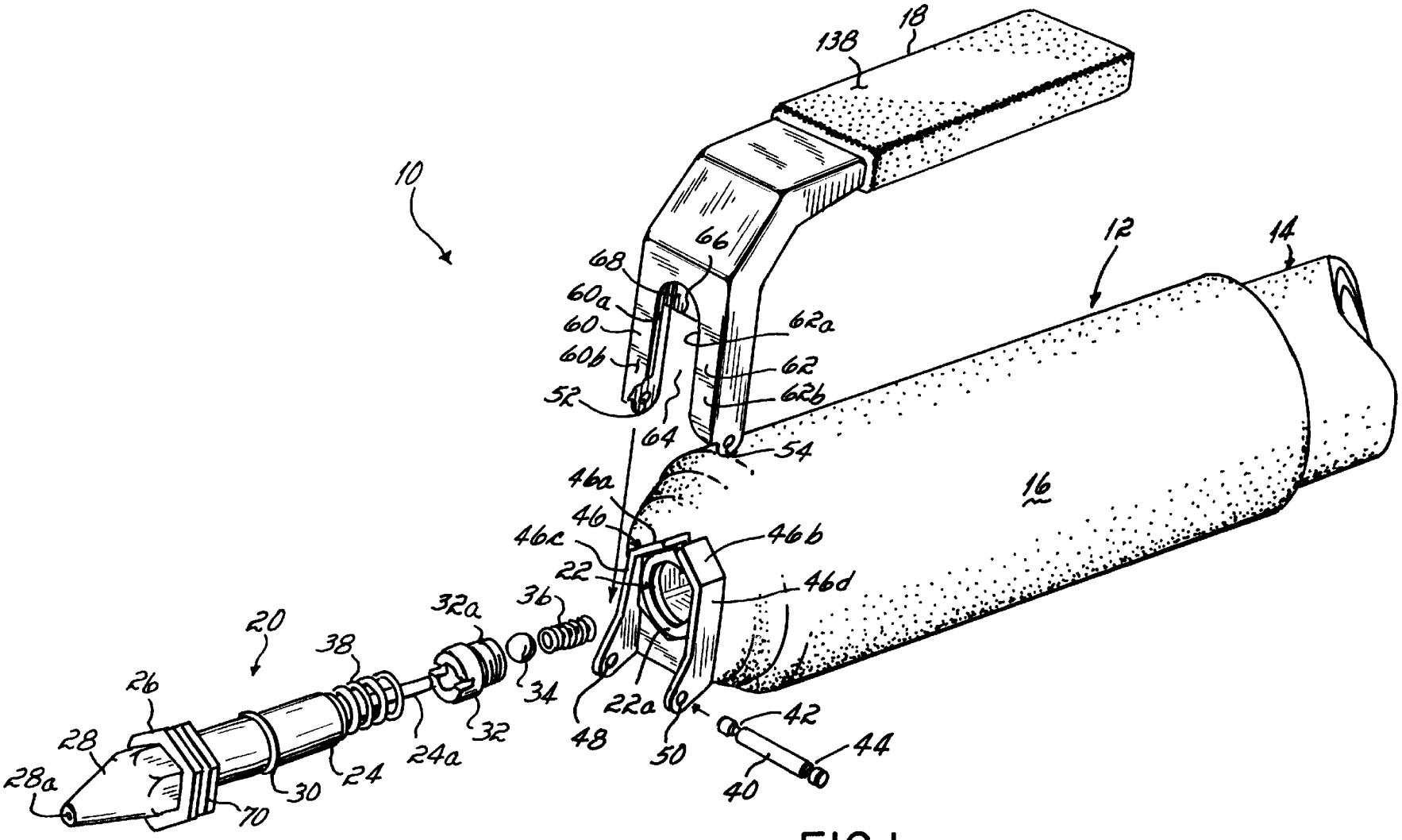
FIG. 1 is an exploded perspective view of a heated handgun and hose assembly constructed in accordance with the preferred embodiment.
Figure 2:
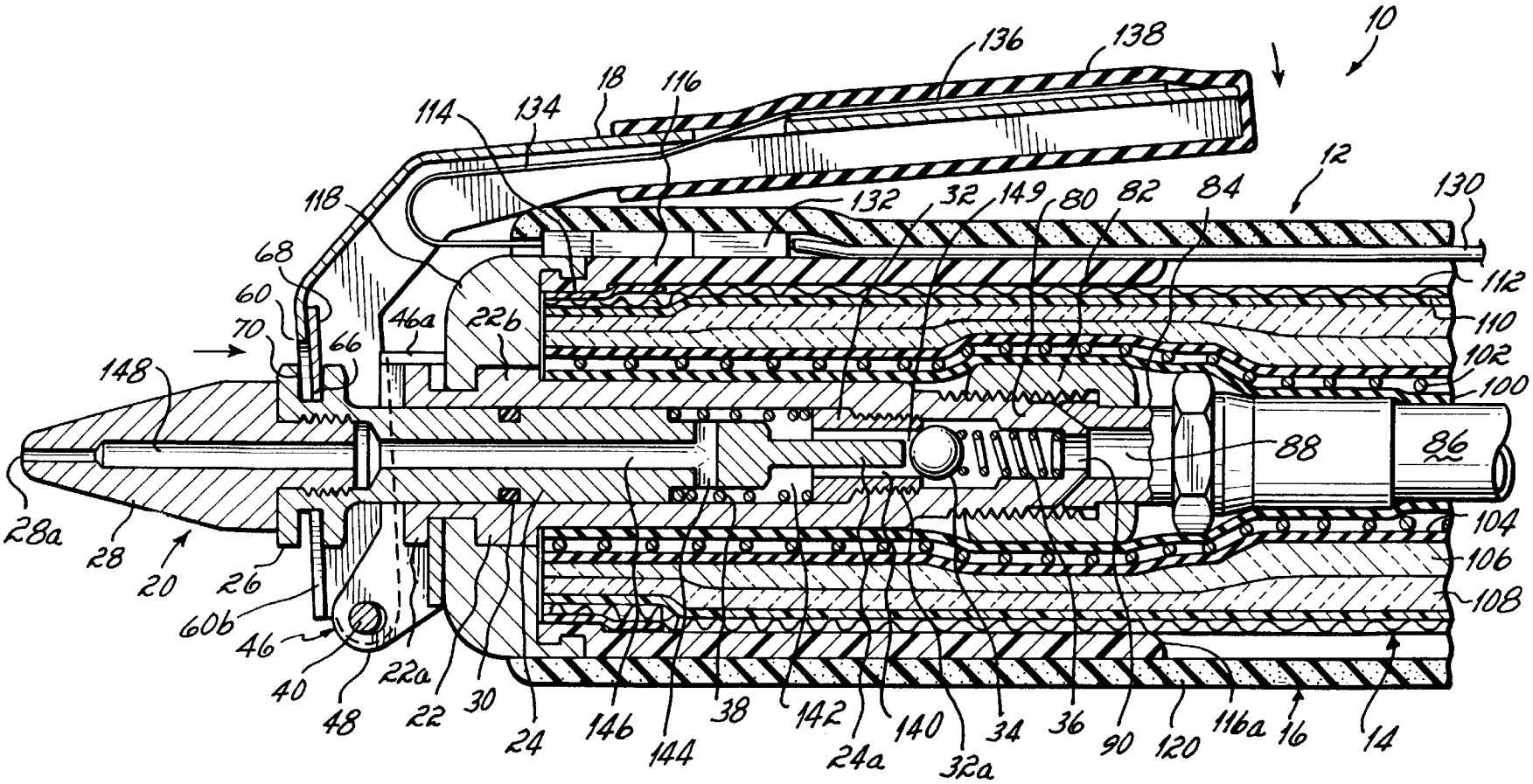
FIG. 2 is an axial cross section of the handgun and hose assembly of FIG. 1 showing the internal valve in a closed position.
Figure 3:
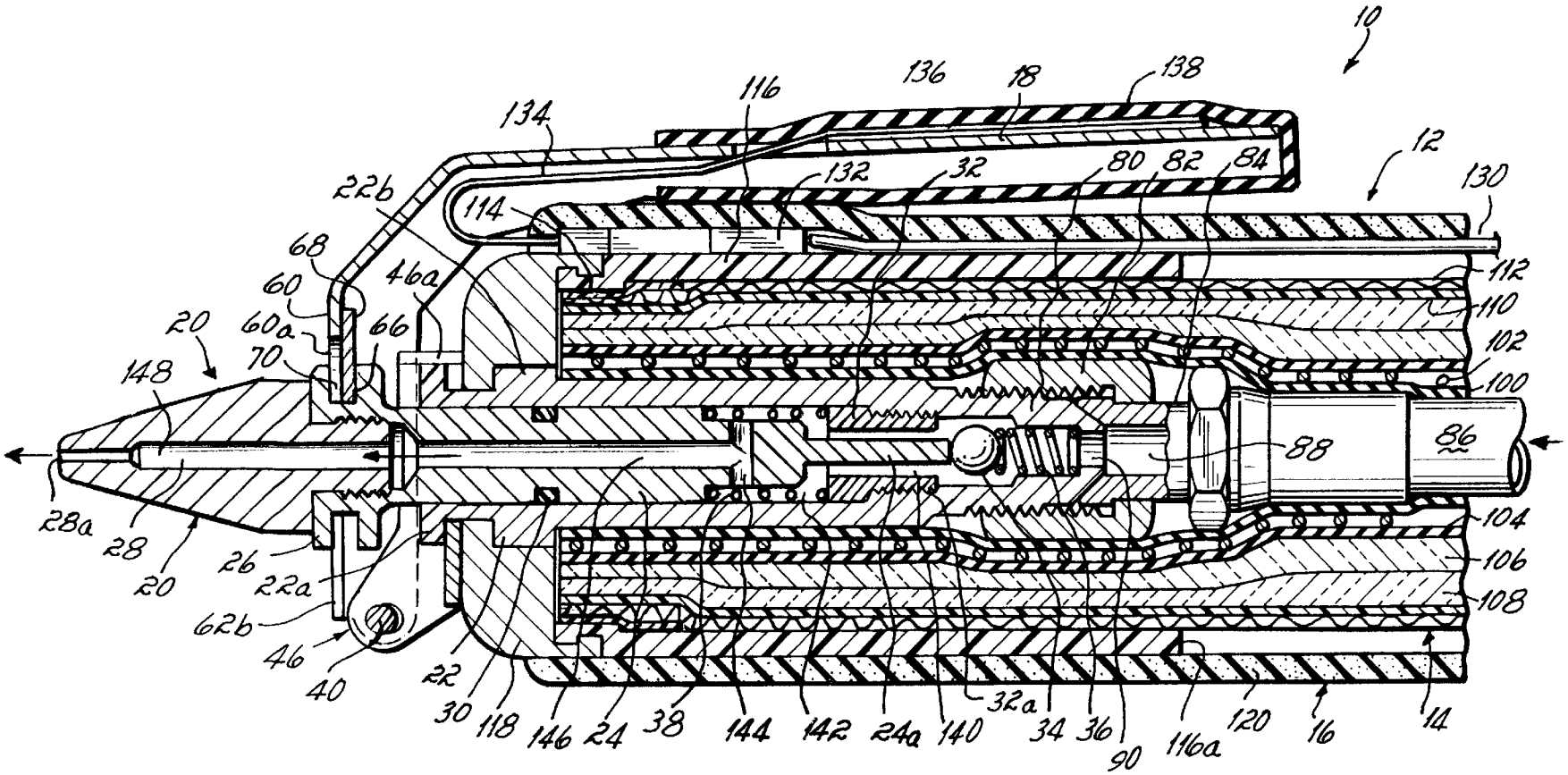
FIG. 3 is a cross sectional view similar to FIG. 2, but showing the internal valve in an open position.

Referring to FIGS. 1–3, the preferred embodiment of handgun and hose assembly 10 includes a handgun 12 connected as a unit or assembly with a hose 14. Various unique features of handgun 12 may be utilized separately and do not require the hose 14 integrated as shown and described herein, however, it is most advantageous to integrate hose 14 as shown. Handgun 12 includes a gripping portion 16 connected with an actuating lever 18. Actuating lever 18 operates a nozzle assembly 20 that forms part of a valve for selectively allowing or preventing the flow of liquid from handgun 12. Nozzle assembly 20 is inserted into a tubular member 22 mounted within gripping portion 16. Specifically, a plunger 24 is mounted for reciprocating movement within tubular member 22. As will be discussed below, a hex portion 26 of plunger 24 connects with actuating lever 18 to facilitate selective, reciprocating movement of plunger 24 in tubular member 22. An O-ring seal 30 is disposed around a central area of plunger 24 and acts as a dynamic seal during the reciprocating movement of plunger 24 within tubular member 22. A nozzle 28 is threaded into hex portion 26 and includes an outlet 28*a* for dispensing the liquid. Although a straight nozzle 28 is shown in the drawings, other nozzle configurations may be used, including angled nozzles.

A valve seat 32 is connected within tubular member 22 in a removable fashion by threads 32*a*. A sealing member, such as a ball 34, is normally held against valve seat 32 by a first spring 36. A second spring 38 is disposed between valve seat 32 and plunger 24 for normally holding plunger 24 in an outward, non-actuated position.

A pivot pin 40 having a pair of chamfered grooves 42, 44 connects actuating lever 18 to a pivot plate 46 having aligned holes 48, 50. A similar pair of aligned holes 52, 54 disposed in legs 60, 62 of actuating lever 18 accept pin 40 as shown in FIGS. 2 and 3. Legs 60, 62 form a slot 64 generally defined by edges 60*a*, 62*a* and an upper edge 66 defined along a separate member 68 rigidly affixed to actuating lever 18.

Edges 60*a*, 62*a* and 66 are received within a groove 70 in hex portion 26 during assembly. Through this connection and the action of pivot pin 40, plunger 24 is moved inwardly or to the right, as viewed in FIGS. 2 and 3, when actuating lever 18 is depressed by the user. When actuating lever 18 is released, spring 38 forces plunger 24 to the left into a deactivated position as shown in FIG. 2.

As further shown in FIGS. 2 and 3, tubular member 22 includes a threaded end 80. Threaded end 80 receives a fitting 82 that connects one end 84 of a hose core 86 to tubular member 22. In this manner, fluid communication is established between a passage 88 in hose core 86 and the internal passage 90 of tubular member 22. As will be described below, passage 90 facilitates the flow of liquid to nozzle outlet 28*a* when handle 18 is depressed by the user. A similar connecting arrangement is preferably used at the opposite end of hose 14 for connecting hose 14 to a dispensing unit (not shown).

Heated hose 14 more specifically comprises a multi-layer construction including a layer of silicone tape 100 wrapped around tubular member 22, fitting 82, and hose core 86. Electric resistance-type heater wire 102 is wrapped around the layer of silicone tape 100 and a second layer of silicone tape 104 is then wrapped around heater wire 102. Two layers of insulating tape 106, 108 are then wrapped around silicone tape 104. Layers 106, 108 may comprise NOMEX brand tape. A plastic tape 110 is then wrapped around insulating layers 106, 108 and, finally, a braided polyester sleeve 112 is used as the outermost hose layer. Each layer extends along the length of hose 14. Hose 14 may connect to a typical dispensing unit, such as a bulk hot melt material dispensing unit (not shown) and hose 14 may be formed in various lengths. Fiberglass tape 114 is wrapped around the end of braided polyester sleeving 112 and a plastic cuff 116 is inserted over the fiberglass tape 114 and the end of braided polyester sleeving 112. Cuff 116 includes a radius 116*a* at the end to provide strain relief with respect to hose 14. A split collar sleeve 118 is connected between cuff 116 and a hex portion 22*b* of tubular member 22. This prevents split collar 118 and the attached cuff 116 from rotating with respect to tubular member 22. Finally, a foam layer 120 provides an outer layer for increased comfort during use.

For applications utilizing electrically-operated pumps or dispensers, handgun 12 receives electrical wiring 130 coupled with suitable connectors 132 leading to a ribbon cable 134. Ribbon cable 134 connects to a membrane switch 136 disposed within actuating lever 18. A vinyl grip 138 covers membrane switch 136. To prevent rotation of actuating lever 18 when electrical connections are established as shown in FIGS. 2 and 3, pivot plate 46 includes tab portions 46*a*, 46*b* as well as side portions 46*c*, 46*d* that engage hex-shaped portion 22*a* of tubular member 22 (FIG. 1). If electrical connections are not necessary, it may be advantageous to allow rotation of actuating lever 18 about gripping portion 16. To facilitate this rotation, hex-shaped portion 22*a* of tubular member 22 may be formed with a circular shape that allows rotation of pivot plate 46 and the attached actuating lever 18. This will be appreciated by reviewing FIGS. 2 and 3 in which the cross-section of portion 22*a* may represent either a hex shape or a circular shape.

Referring to FIGS. 2 and 3, handgun 12 is operated by grasping gripping portion 16 and depressing actuating lever 18. As finger or hand pressure is applied to actuating lever 18 over vinyl grip 138, membrane switch 136 is activated to cause a pump motor (not shown) to turn on and liquid pressure within hose core 86 to build up. Further pressure on actuating lever 18 causes lever 18 to rotate about grooved pivot pin 40 and apply longitudinal force to move plunger 24. Plunger 24 has a reduced diameter end 24*a* that pushes sealing ball 34 off of valve seat 32 during this longitudinal movement. As shown in FIG. 3, this allows liquid to flow around sealing ball 34 and through passage 140 in valve seat 32 into passage 142 of tubular member 22. From passage 142, the liquid flows through spring 38 and into a plurality of radial passages 144 in plunger 24. The liquid then travels through a central passage 146 of plunger 24 into a passage 148 of nozzle 28 and passes through nozzle outlet 28*a*.

Actuating lever 18 has a limited range of rotation determined by the geometry of groove 70 formed in hex portion 26 of plunger 24. As actuating lever 18 is depressed, rotation occurs until the lower portions of front surfaces 60*b*, 62*b* of legs 60, 62 contact the front interior surfaces of groove 70 as shown in FIG. 3. The lower rear surfaces of groove 70 act similarly as a stop to limit rotation of actuating lever 18 in the opposite direction as shown in FIG. 2. To facilitate this feature in the preferred embodiment, the width of groove 70 is about 0.005"–0.010" larger than the width of member 68 added to the width of either edge 60*a*, 62*a*. This limits the range of motion of plunger 24 and prevents actuating lever 18 from protruding too far outward, thereby allowing handgun 12 to be used by individuals with both large and small gripping capabilities. Once sealing ball 34 fully contacts valve seat 32 upon returning to the closed or deactivated position shown in FIG. 2, a small additional amount of travel of plunger 24 in the outward direction causes an increase in volume of passage 142. This small increase in volume after valve closure causes the liquid to suck-back slightly at nozzle outlet 28*a* to help increase cut-off performance and prevent drooling or dripping of liquid from outlet 28*a*. The amount of volume increase may be adjusted by varying the geometry of groove 70 or by adjusting the length of reduced diameter portion 24*a* of plunger 24 to form a larger or smaller gap 149. As mentioned above, copper alloys are preferably used to construct tubular member 22, plunger 24, nozzle 28 and valve seat 32. These materials have high heat transfer properties. Thus, coupled with the fact that heated hose 14 envelops substantially the entire length of tubular member 22, heat may be efficiently and thoroughly transferred to nozzle 28 and, specifically, nozzle tip 28*a*. This ensures that the liquid will not cool substantially prior to its discharge from nozzle outlet 28*a*. Metals, such as stainless steel, having low heat transfer properties are preferably used to construct actuating lever 18, grooved pin 40, and pivot plate 46 to help prevent the operator from contacting hot surfaces.

To access valve seat 32 or other internal valve components, pin 40 is simply removed to then allow manual removal of actuating lever 18. Nozzle assembly 20 may then be removed from tubular member 22 as shown in FIG. 1. Thus far, tools are not required for disassembly. A screwdriver may then be used to unthread and remove valve seat 32 for replacement or repair. Other components, such as springs 36, 38 or ball 34 may be replaced at this time as well.

While the present invention has been illustrated by a description of a preferred embodiment and while this embodiment has been described in some detail, it is not the intention of the Applicants to restrict or in any way limit the scope of the appended claims to such detail. Additional advantages and modifications will readily appear to those skilled in the art. This has been a description of the present invention, along with the preferred methods of practicing the present invention as currently known. However, the invention itself should only be defined by the appended claims, Wherein we claim:

1. A heated handgun and hose assembly comprising:

a hose having a multi-layer construction including a hose core with a liquid flow passage, and outer layers including an electric heating layer and at least one layer of thermal insulation;

a tubular member mounted within said outer layers at one end portion of said hose;

a nozzle having an outlet and coupled for thermal and fluid communication with said tubular member ;

a valve mounted in said tubular member; and an actuating member coupled to said valve for moving said valve between open and closed positions to respectively allow and prevent liquid flow through the passage in said hose core and through said tubular member and said nozzle outlet.

2. The heated handgun and hose assembly of claim 1, wherein said nozzle is connected for movement with said valve and said actuation member between said open and said closed positions.

3. The heated handgun and hose assembly of claim 1, wherein said valve further comprises a plunger, a valve seat and a sealing member disposed for selective disengagement and engagement with said valve seat to respectively define said open and closed positions, wherein said plunger is operatively connected for movement with said nozzle and operates said sealing member between said open and closed positions.

4. The heated handgun and hose assembly of claim 3, wherein said plunger is normally biased in a direction away from said sealing member and said sealing member is normally biased into engagement with said valve seat.

5. The heated handgun and hose assembly of claim 1, wherein said valve includes a valve seat removably affixed within said tubular member.

6. The heated handgun and hose assembly of claim 1 further comprising a membrane switch coupled with said actuation member for electrically actuating a pump to supply liquid through said hose.

7. A handgun and hose assembly for dispensing liquid, the assembly comprising:

a hose including an end portion for conveying said liquid, a nozzle coupled for fluid communication with the end portion of said hose;

a valve member operatively connected with said nozzle and movable between open and closed positions to selectively allow and prevent liquid flow through said nozzle;

a straight, tubular gripping portion extending generally along an axis and coupled in generally surrounding relation to the end portion of said hose; and an actuation member including a manually operable actuating portion coupled to said valve member for moving said valve member between said open and closed positions, wherein said gripping portion, said actuating portion and the end portion of said hose each extend generally parallel to one another to allow gripping and actuation by a user in multiple hand and hose orientations and said actuating portion is rotatable at least partially around said gripping portion and said axis.

8. The handgun and hose assembly of claim 7, wherein said actuating portion is on a lever extending generally along an outer surface of said gripping portion.

9. The handgun and hose assembly of claim 7, wherein said nozzle extends generally parallel to said gripping portion, said actuating portion and the end portion of said hose.

10. A handgun and hose assembly for dispensing liquid, the assembly comprising:

a hose including an end portion for conveying said liquid;

a handgrip carried by said hose and including a front end:

a nozzle coupled for fluid communication with the end portion of said hose and extending forwardly from the front end of said handgrip;

a valve member operatively connected for movement with said nozzle and movable between open and closed positions so as to selectively allow and prevent liquid flow through said nozzle; and an actuating member including a manually operable lever coupled to said valve member at a coupling defining a pivot point located between said nozzle and said front end, said lever extending rearwardly over said handgrip and pivoting toward said handgrip for moving said valve member between said open and closed positions along a predetermined stroke length, said stroke length being limited by the coupling between said actuating member and said valve member.

11. The handgun and hose assembly of claim 10, wherein said nozzle is coupled for movement with said valve member along said stroke length.

12. The handgun and hose assembly of claim 10, wherein said lever includes a first end portion for manual actuation by the hand of a user and a second end portion, and further comprising a tubular member receiving said valve member and a pivot member coupled with said tubular member and pivotally coupled to the second end portion of said lever, said valve member including a slot receiving a portion of said lever disposed between said first and second end portions, whereby the interaction of said valve member, said lever and said pivot member limits the movement of said valve member.

13. A handgun and hose assembly for dispensing liquid, the assembly comprising:

a hose including an end portion for conveying said liquid;

a nozzle having an outlet and coupled for fluid communication with the end portion of said hose;

a tubular member connected for fluid communication between said nozzle and the end portion of said hose;

a valve seat positioned in said tubular member;

an actuating member; and a plunger received by said tubular member and movable by said actuating member between open and closed positions with respect to said valve seat to selectively allow and prevent liquid flow through said nozzle outlet, said plunger being configured to increase the interior volume of said tubular member at a location downstream of said valve seat while moving into said closed position to thereby suck liquid back into said nozzle outlet.

14. The handgun and hose assembly of claim 13 further comprising a valve seat removably disposed within said tubular member and a seal member mounted for selective engagement with said valve seat and said plunger, wherein said plunger extends through said valve seat when in the open position to disengage said seal member from said valve seat and retracts in an opposite direction to allow said seal member to engage said valve seat and to increase the interior volume of said tubular member.

15. The handgun and hose assembly of claim 14, wherein said seal member is biased into engagement with said valve seat in the closed position and said plunger is biased out of engagement with said seal member in the closed position.

16. A handgun and hose assembly for dispensing liquid, the assembly comprising:

a hose including an end portion for conveying said liquid, a nozzle having an outlet and coupled for fluid communication with the end portion of said hose;

a tubular member having a front end connected for fluid communication with said nozzle and a rear end connected for fluid communication with the end portion of said hose;

a valve seat removably received by said tubular member;

a plunger mounted for movement within said tubular member between open and closed positions;

a sealing member positioned within said tubular member, said sealing member spaced away from said valve seat when said plunger is in the open position; and a first spring in said tubular member biasing said plunger in a direction away from said sealing member;

a second spring in said tubular member biasing said sealing member against said valve seat when said plunger is in said closed position;

an actuating member coupled to said plunger for moving said plunger between said open and closed positions;

wherein said nozzle, plunger, valve seat and sealing member are each removable from the front end of said tubular member.

* * * * *